US006712674B2

(12) United States Patent
Matsuo et al.

(10) Patent No.: US 6,712,674 B2
(45) Date of Patent: Mar. 30, 2004

(54) POLISHING APPARATUS AND POLISHING METHOD

(75) Inventors: Makoto Matsuo, Kyoto (JP); Masataka Takehara, Kyoto (JP); Michio Osada, Kyoto (JP)

(73) Assignee: Towa Corporation, Kyoto (JP)

( * ) Notice: Subject to any disclaimer, the term of this patent is extended or adjusted under 35 U.S.C. 154(b) by 90 days.

(21) Appl. No.: 09/957,083

(22) Filed: Sep. 19, 2001

(65) Prior Publication Data

US 2002/0037685 A1 Mar. 28, 2002

(30) Foreign Application Priority Data

Sep. 26, 2000 (JP) ..... 2000-291728

(51) Int. Cl.[7] ..... B24B 1/00

(52) U.S. Cl. ..... 451/41; 451/270; 451/287; 451/291

(58) Field of Search ..... 451/41, 60, 285–291, 451/270, 271, 63

(56) References Cited

U.S. PATENT DOCUMENTS 3,172,241 A 3/1965 Habenicht
4,771,578 A 9/1988 Jorgensen et al.
5,554,064 A 9/1996 Breivogel et al.
5,624,299 A * 4/1997 Shendon ..... 451/28
5,672,095 A * 9/1997 Morimoto et al. ..... 451/41
5,820,448 A * 10/1998 Shamouilian et al. ..... 451/287
5,913,718 A * 6/1999 Shendon ..... 451/288
6,019,671 A * 2/2000 Shendon ..... 451/56
6,095,904 A * 8/2000 Breivogel et al. ..... 451/41
6,184,139 B1 * 2/2001 Adams et al. ..... 438/691
6,250,994 B1 * 6/2001 Chopra et al. ..... 451/56
6,315,641 B1 * 11/2001 Lee et al. ..... 451/41

FOREIGN PATENT DOCUMENTS

EP 0865075 9/1998

* cited by examiner

*Primary Examiner*—M. Rachuba
(74) *Attorney, Agent, or Firm*—W. F. Fasse; W. G. Fasse

(57) ABSTRACT

A polishing apparatus includes a polishing pad rotated by a surface plate rotating shaft about a surface plate axis, a slurry conduit supplying slurry to an upper surface of the polishing pad, a substrate holding mechanism holding a substrate, a substrate rotating shaft rotating the substrate holding mechanism about a substrate axis, and a rotating mechanism rotating the substrate axis or the surface plate axis about an eccentric axis. The angular velocity of rotation about the eccentric axis is set larger than the angular velocity of rotation about the substrate axis or the surface plate axis. Thus, the effective contact area between a small area on the substrate and the polishing pad is increased, biased wear of abrasive grains on the polishing pad is prevented, clogging of the polishing pad is suppressed, and new abrasive grains and new chemicals can be supplied with high efficiency to each area of the substrate. Thus, the polishing rate is improved.

6 Claims, 6 Drawing Sheets

POLISHING APPARATUS AND POLISHING METHOD

BACKGROUND OF THE INVENTION

1. Field of the Invention

The present invention relates to a polishing apparatus and a polishing method, in which a substrate to be polished such as a silicon substrate is polished by CMP (Chemical Mechanical Polishing).

2. Background Art

A semiconductor substrate such as a silicon substrate (hereinafter referred to as a substrate) with buried interconnections and interlayer insulating films formed has protruded portions and recessed portions on a surface of the substrate. Recently, as patterns have been miniaturized, when process steps are proceeded with protruded portions and recessed portions existing on the substrate surface, pattern disconnection of upper interconnections and defocus at a step of exposure for forming a resist pattern result from steps or level differences, significantly reducing production yield. In order to prevent such problems, conventionally, the polishing method referred to as CMP has been used, in order to planarize the substrate surface.

This method will be described with reference to FIGS. 6A, 6B and 6C. These figures represent positional relation between a polishing pad and the substrate when the substrate is polished by the conventional polishing apparatus and polishing method, time sequentially, for each unit time. In FIGS. 6A, 6B and 6C, a polishing pad 100 fixed on a surface plate (not shown) rotates about a surface plate axis A. To an upper surface of polishing pad 100, liquid (not shown) referred to as slurry containing abrasive grains such as silica is supplied. A substrate 101 held by suction, for example, is pressed against polishing pad 100 while it is rotated about a substrate axis B, whereby an object of polishing on the substrate surface is polished.

In the CMP, a chemical reaction attained by chemicals such as KOH solution and mechanical polishing attained by the abrasive grains, both of which are contained in the slurry, are utilized to planarize the substrate surface. Here, generally, the number of rotation of the polishing pad 100 is set to be higher than the number of rotation of substrate 101.

In the conventional polishing, however, it is difficult to increase polishing rate for planarization, that is, to increase thickness of the object of polishing removed per unit time. In the following, description will be given taking a small area Q on the surface of substrate 101 shown in FIGS. 6A, 6B and 6C as an example.

The polishing rate depends on the characteristics of the chemicals and the abrasive grains with respect to the material of the film formed on the surface of substrate 101, and on the area at which the small area Q and polishing pad 100 are in contact with each other per unit time (hereinafter referred to as "contact area"). Accordingly, when the numbers of rotation of polishing pad 100 and substrate 101 are increased, contact area increases, and therefore, the polishing rate increases.

Now, consider a specific abrasive grain of polishing pad 100. The direction at which the abrasive grain contacts with the direction of rotation of substrate 101 is limited. For example, an abrasive grain existing on a virtual arc 102 close to an outer periphery of polishing pad 100 moves in the 5:00 direction (direction of arrow S with respect to arrow R), 6:00 direction and 7:00 direction (direction of arrow U with respect to arrow T) relative to the direction of rotation of substrate 101, and is brought into contact from these directions. Generally, an abrasive grain extending on a virtual arc 103 in the middle between the outer periphery and the center of polishing pad 100 moves in the 4:00 direction (direction of arrow W with respect to arrow V, 6:00 direction and 8:00 direction and is brought into contact from these directions. Similarly, an abrasive grain existing on a virtual arc 104 close to the center of polishing pad 100 moves in the 2:00 direction (direction of arrow Y with respect to arrow X), 12:00 direction and 10:00 direction and is brought into contact from these directions.

In this manner, each abrasive grain is brought into contact only from a specific range of directions with respect to the direction of rotation of substrate 100. In other words, each of the abrasive grains existing on virtual arcs 102, 103 and 104 on polishing pad 100 is brought into contact with each small area of substrate 101 from a prescribed range of directions. This means that individual abrasive grain tends to wear in a biased manner (uneven wear), and therefore, even when the numbers of rotation of polishing pad 100 and substrate 101 are increased, increase in the polishing rate stops after a while.

Further, from the position of FIG. 6A to the position of FIG. 6C, the small area Q only moderately moves, drawing a simple arc with the substrate axis B being the center, with respect to polishing pad 100. In other words, on polishing pad 100, each small area of substrate 101 moves moderately, drawing an arcuate orbit. Therefore, when fragments of abrasive grains dropping out from the upper surface of polishing pad 100 or fragments removed from the surface of substrate 100 cause a clogging, it is difficult to remove the clogging, as each small area of substrate 101 moves arcuately. This makes it difficult to increase the polishing rate.

The present invention was made to solve the above described problems, and its object is to provide a polishing apparatus and polishing method that can increase the polishing rate.

SUMMARY OF THE INVENTION

In order to solve the above described technical problems, the present invention provides a polishing apparatus in which a substrate to be polished rotated by a substrate shaft is pressed against a polishing pad with a prescribed pressure, while slurry is supplied to an upper surface of the polishing pad rotated by a surface plate shaft, so that the surface of the target substrate is polished, including a rotating mechanism that rotates at least one of a surface plate axis as a rotation central axis of the surface plate shaft and a substrate axis as a rotation central axis of the substrate rotating shaft about a corresponding prescribed eccentric axis.

Accordingly, on the polishing pad, distance of movement of a small area held by the substrate to be polished increases and, hence, contact area between the small area and the polishing pad increases.

Further, each abrasive grain held by the polishing pad comes to be brought into contact with a small area of the substrate to be polished, from various and many directions as compared with the conventional polishing. Accordingly, first, biased wear of each abrasive grain is prevented. Next, on the upper surface of the polishing pad, it becomes easier to remove any clogging caused by fragments of the abrasive grains dropped off from the surface or fragments removed from the surface of the target substrate.

In a preferred embodiment of the polishing apparatus in accordance with the present invention, in the polishing apparatus described above, angular velocity of rotation of at least one of the surface plate axis and the substrate axis about the corresponding eccentric axis is made larger than that of the angular velocity of rotation of the target substrate about the substrate axis.

Accordingly, at least one of the polishing pad and the substrate to be polished revolves about the eccentric axis, at an angular velocity larger than the rotation about the substrate axis. Therefore, the slurry can be diffused uniformly with high efficiency between the polishing pad and the substrate to be polished.

In order to solve the above described technical problems, the present invention provides a polishing method in which slurry is supplied to an upper surface of a polishing pad rotated by a surface plate rotating shaft, a substrate to be polished is rotated by a substrate rotating shaft and the substrate to be polished is pressed against the polishing pad with a prescribed pressure, so that the surface of the target substrate is polished, including the step of rotating at least one of a surface plate axis as a rotation central axis of the surface plate rotating shaft and a substrate axis as a rotation central axis of the substrate rotating shaft, about a corresponding prescribed eccentric axis.

Accordingly, on the polishing pad, the distance of movement of the small area held by the substrate to be polished is increased and, hence, the contact area between the small area and the polishing pad can be increased.

Further, each abrasive grain held by the polishing pad comes to be brought into contact with a small area of the substrate to be polished from various and many directions as compared with the conventional polishing. Accordingly, first, bias wear of each abrasive grain can be prevented. Further, on the upper surface of the polishing pad, it becomes easier to remove any clogging generated by fragments of the abrasive grains dropped out from the surface or fragments removed from the surface of the target substrate.

In the preferred embodiment of the polishing method in accordance with the present invention, in the polishing method described above, at least one of the surface plate axis and the substrate axis is rotated about the corresponding prescribed eccentric axis at an angular velocity larger than that of rotation of the target substrate about the substrate axis.

Accordingly, at least one of the polishing pad and the substrate to be polished is revolved around the eccentric axis at an angular velocity larger than that of the rotation about the substrate axis. Therefore, it is possible to diffuse the slurry uniformly with high efficiency between the polishing pad and the substrate to be polished.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
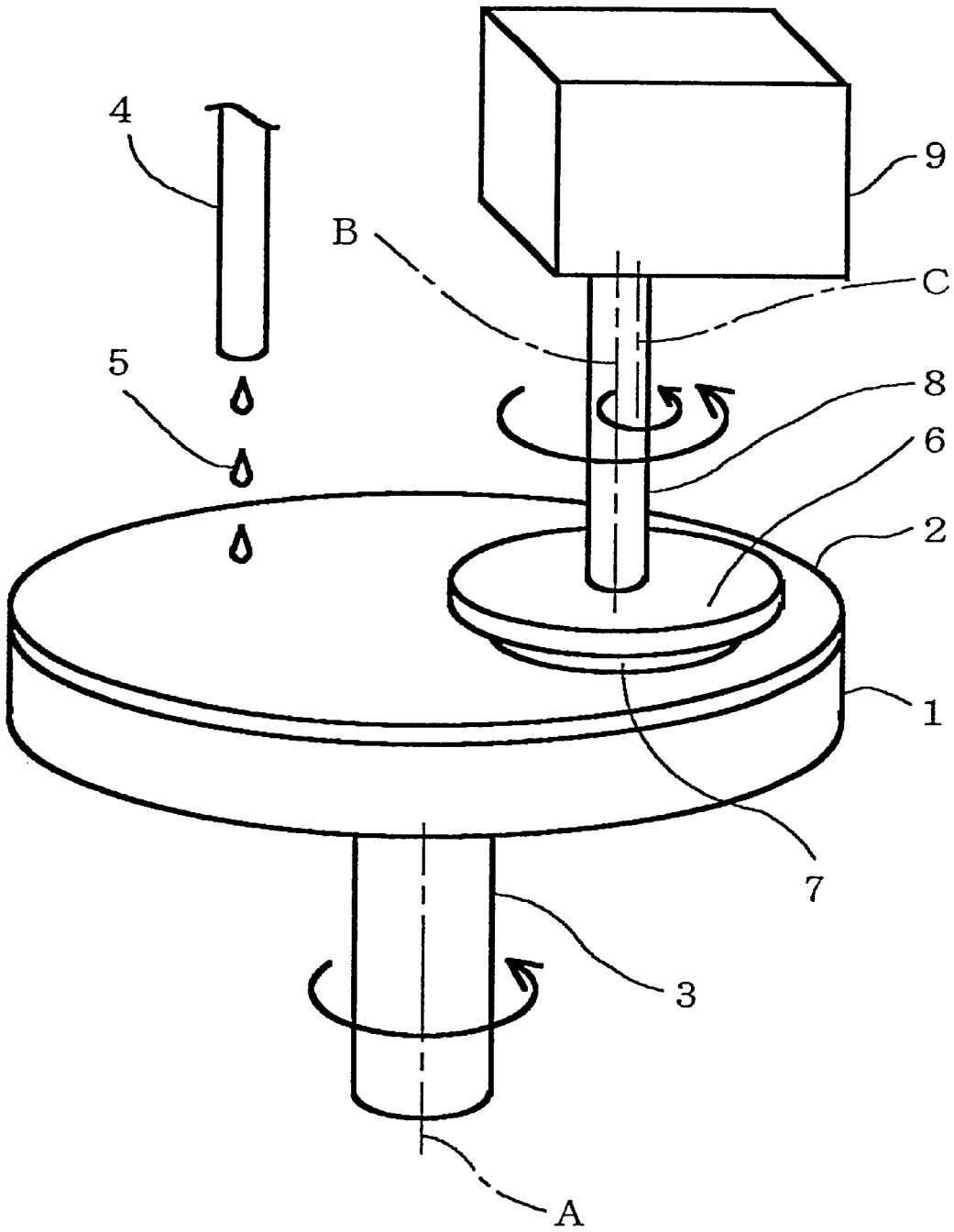
FIG. 1 is a perspective view representing a configuration of the polishing apparatus in accordance with the present invention.

The polishing apparatus and the polishing method in accordance with one embodiment of the present invention will be described with reference to FIGS. 1, 2 and 3A to 3F. FIG. 1 is a perspective view of the polishing apparatus in accordance with the present embodiment. Referring to FIG. 1, a polishing pad 2 is adhered on a surface plate 1. Surface plate 1 is rotated by surface plate rotating shaft 3 that rotates about a surface plate axis A. A slurry duct 4 drops slurry 5 onto polishing pad 2. A substrate holding mechanism 6 holds a substrate 7 by suction, for example, and is rotated about substrate axis B, by a substrate rotating shaft 8. Rotating mechanism 9 rotates substrate rotating shaft 8 about the substrate axis B, and rotates the substrate axis B itself about an eccentric axis C.

Figure 2:
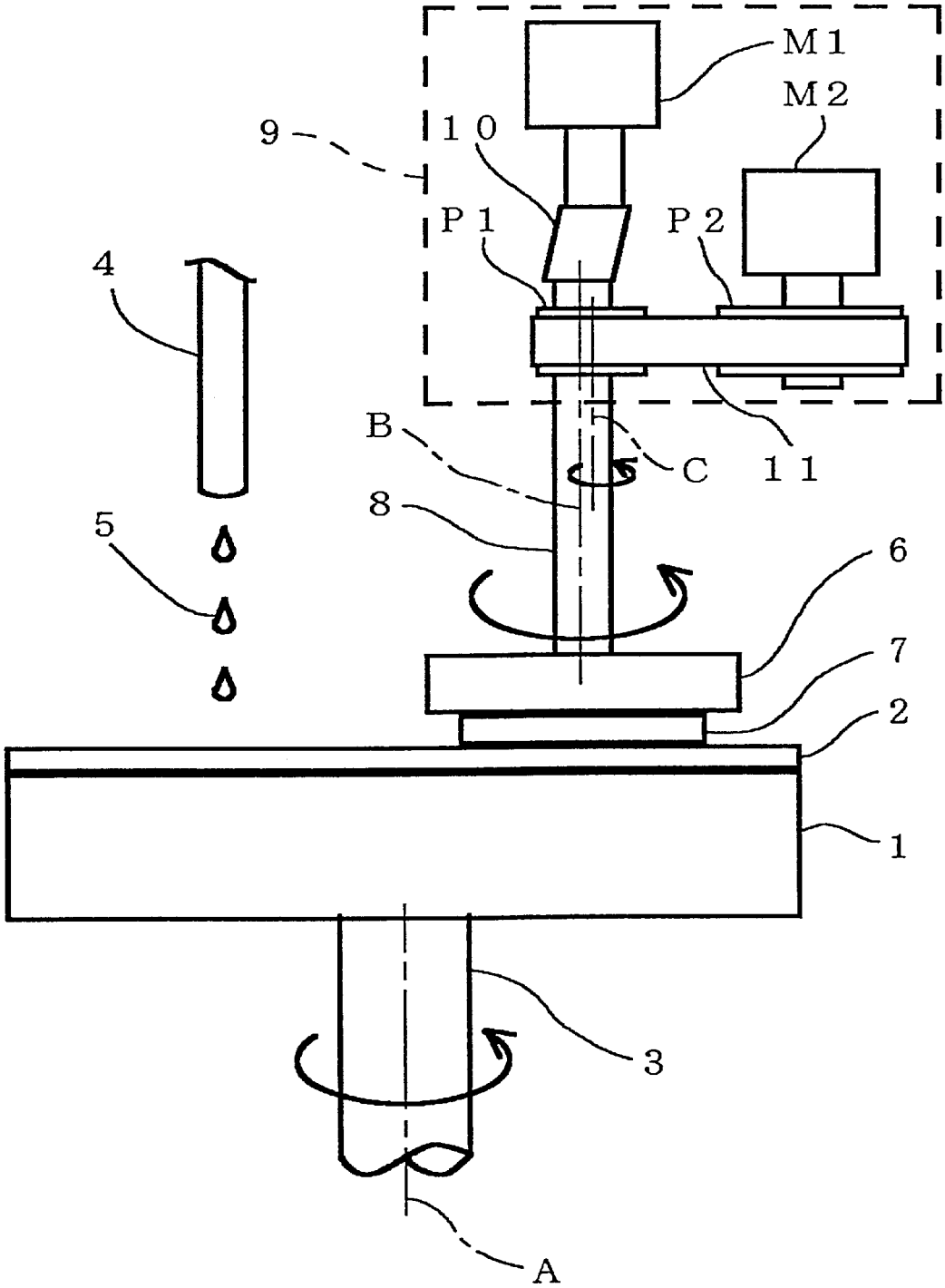
FIG. 2 is front view showing the polishing apparatus of FIG. 1, and particularly, the structure of the rotating mechanism.

FIG. 2 is a front view of the rotating mechanism of the polishing apparatus shown in FIG. 1. Referring to FIG. 2, substrate rotating shaft 8 is connected to the rotating shaft of substrate rotating motor M1 by means of a universal joint 10. A pulley P1 is eccentrically fixed on substrate rotating shaft 8, while a pulley P2 is fixed centered with the rotating shaft of an eccentric rotating motor M2. Pulley P1 and pulley P2 are linked by means of a belt 11. Pulleys P1, P2, universal joint 10, belt 11, substrate rotating motor M1 and eccentric rotating motor M2 constitute the rotating mechanism 9.

The operation of the polishing apparatus shown in FIG. 2 will be described. As the rotating shaft of substrate rotating motor M1 rotates, substrate rotating shaft 8 rotates about the substrate axis B, through universal joint 10. Accordingly, substrate 7 held by substrate holding mechanism 6 rotates about the substrate axis B.

On the other hand, as the rotating shaft of eccentric rotating motor M2 rotates, pulley P1 rotates about eccentric axis C, through pulley P2 and belt 11, successively. Accordingly, substrate axis B of substrate rotating shaft B rotates about the eccentric axis C. Here, angular velocity when the substrate axis B rotates about the eccentric axis C is set to be larger than the angular velocity when the substrate rotating shaft 8 rotates about the substrate axis B. Therefore, it follows that the substrate 7 held by substrate holding mechanism 6 rotates about the substrate axis B while it revolves around the eccentric axis C at an angular velocity larger than that of the rotation.

FIGS. 3A to 3F represent positional relations between the polishing pad and the substrate when the substrate is polished by the polishing apparatus and the polishing method of the present embodiment, time sequentially for the unit time period. As can be seen from FIG. 3A, polishing pad 2 rotates about the surface plate axis A. Here, the reference character P is a virtual reference character to represent the state of rotation of polishing pad 2.

Referring to FIGS. 3A to 3F, how a small area Q on substrate 7 moves as the unit time passes will be described in the following. Here, polishing pad 2 is set to rotate by $\pi/4$ rad (=45°) about the surface plate axis A per unit time. Further, substrate 7 is set to rotate by $\pi/12$ rad (=15°) about the substrate axis B and by $\pi/2$ rad (=90°) about the eccentric axis C, per unit time period respectively.

Figure 3A:
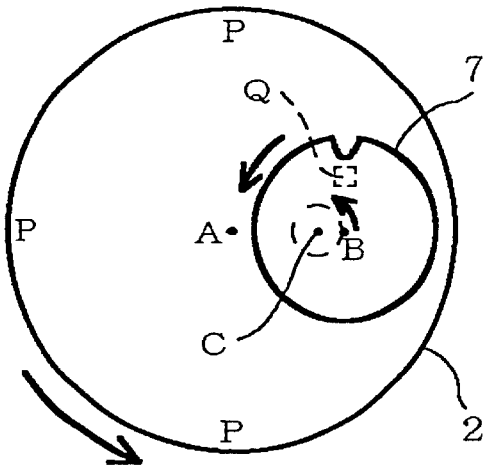
FIGS. 3A to 3F are plan views representing positional relations between the polishing pad and the substrate when the substrate is polished by the polishing apparatus and the polishing method in accordance with the present invention, time sequentially for unit time period.
Figure 3D:
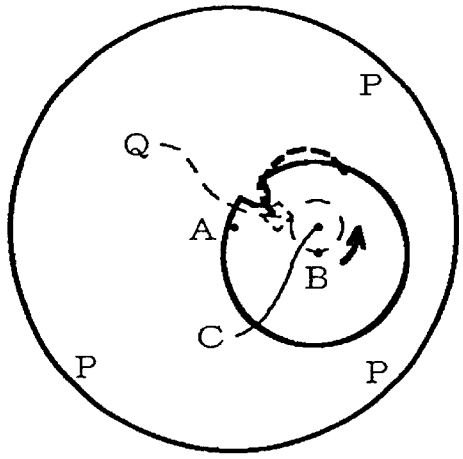
Figure 3B:
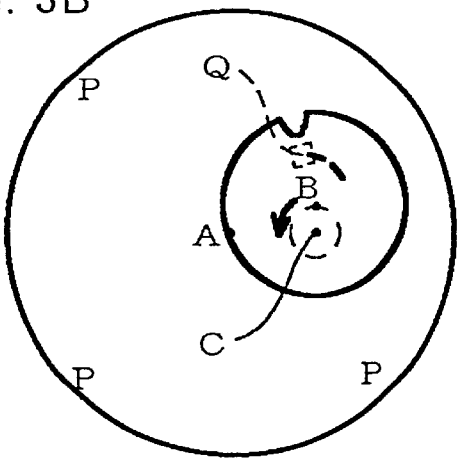

From the state of FIG. 3A to the state of FIG. 3B, small area Q of substrate 7 moves as represented by the thick dotted line of FIG. 3B. Thereafter, small area Q moves successively, and to the state of FIG. 3F, it moves spirally as represented by the thick dotted line of FIG. 3F.

Figure 3E:
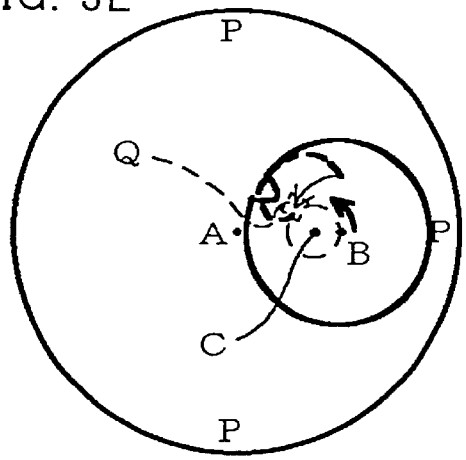
Figure 3C:
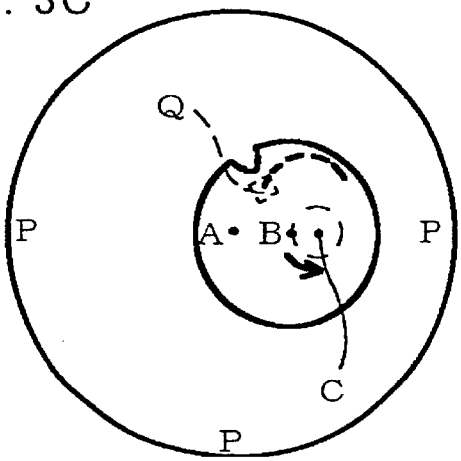
Figure 3F:
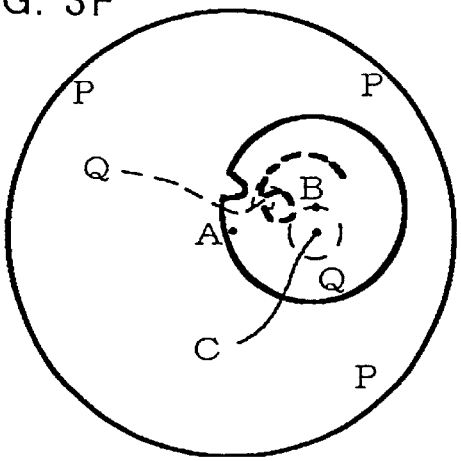

Now, let us consider the orbit of small area Q at a time point when substrate 7 revolves only once about the eccentric axis C from the state of FIG. 3A, that is, the time point at which the state of FIG. 3E is established. According to the present invention, the small area Q moves as represented by the thick dotted line of FIG. 3E. On the other hand, by the conventional polishing in which substrate 7 rotates only about the substrate axis B, the small area Q moves in an arcuate manner as represented by the thin arrow of FIG. 3E. As is apparent from the comparison between the thick dotted line and the thin arrow, the present invention has the following characteristics.

First, the distance of movement of the small area Q increases and hence, the contact area between the small area Q and the polishing pad 2 increases. Thus, polishing rate increases.

Second, the small area Q is brought into contact with each of the abrasive grains of polishing pad 2 from various and many directions, different from the conventional polishing. Accordingly, biased wear of each abrasive grain is prevented. Further, it becomes easier to remove any clogging of the upper surface of polishing pad 2 caused by fragments of abrasive grains dropped out from the surface or fragments removed from the surface of the substrate 7. Therefore, on the upper surface of polishing pad 2, biased wear of the abrasive grains can be prevented and the clogging can be suppressed, whereby the polishing rate can be increased.

Third, on the polishing pad 2, substrate 7 revolving around the eccentric axis C at an angular velocity larger than that of rotation about the substrate axis B diffuses slurry 5 uniformly with higher efficiency. Thus, new abrasive grains and new chemicals can be supplied with high efficiency to each area of substrate 7, increasing the polishing rate.

As described above, according to the polishing apparatus and the polishing method in accordance with the present embodiment, the contact area between the small area Q and polishing pad 2 increases. Further, bias wear of the abrasive grains on polishing pad 2 is prevented. Further, clogging of polishing pad 2 is suppressed. In addition, new abrasive grains and new chemicals are supplied with high efficiency to each area of substrate 7. From these factors, it becomes possible to increase the polishing rate.

Figure 4:
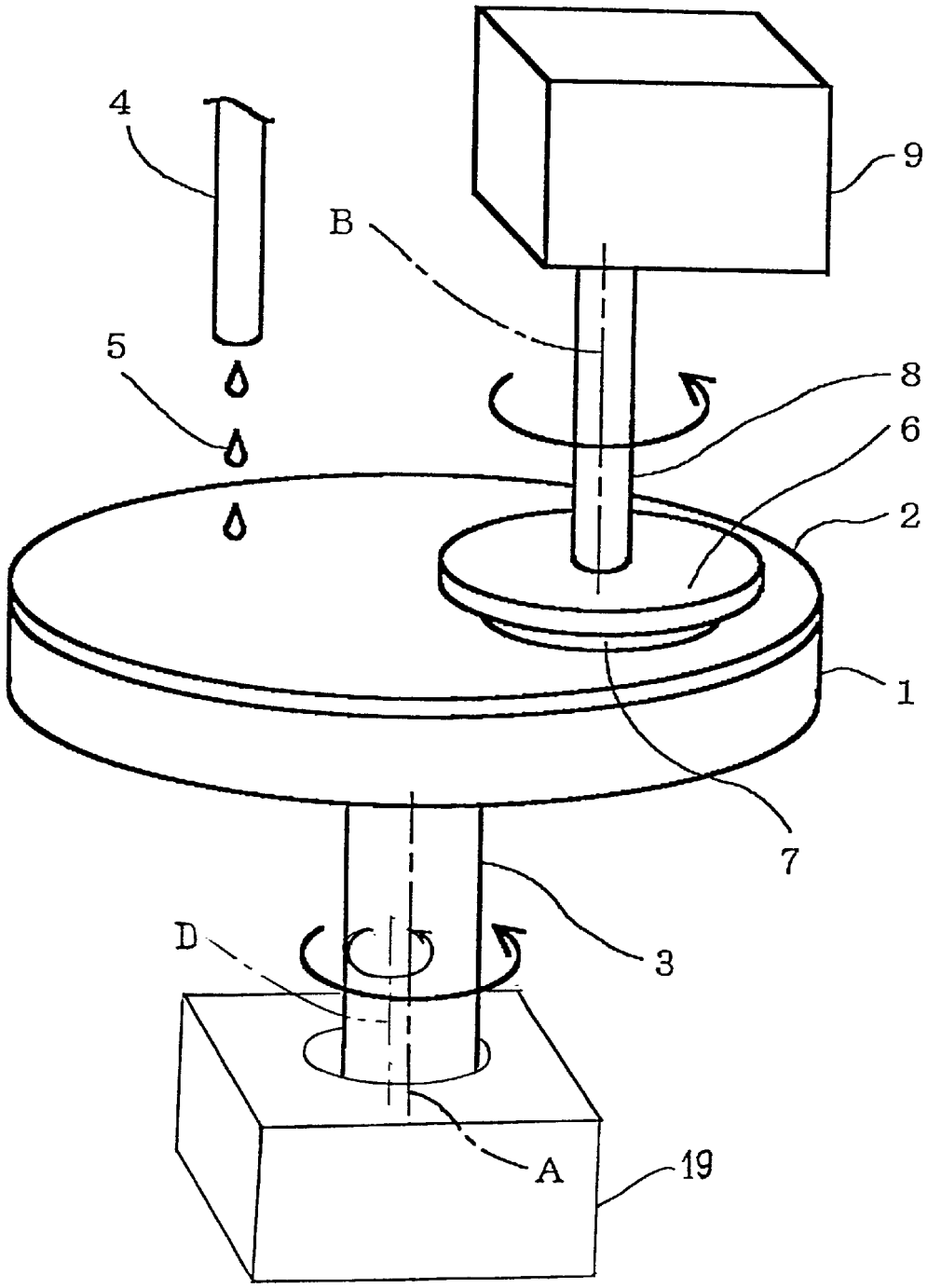
FIG. 4 is a perspective view representing a structure of a modification of the polishing apparatus in accordance with an embodiment.
Figure 5:
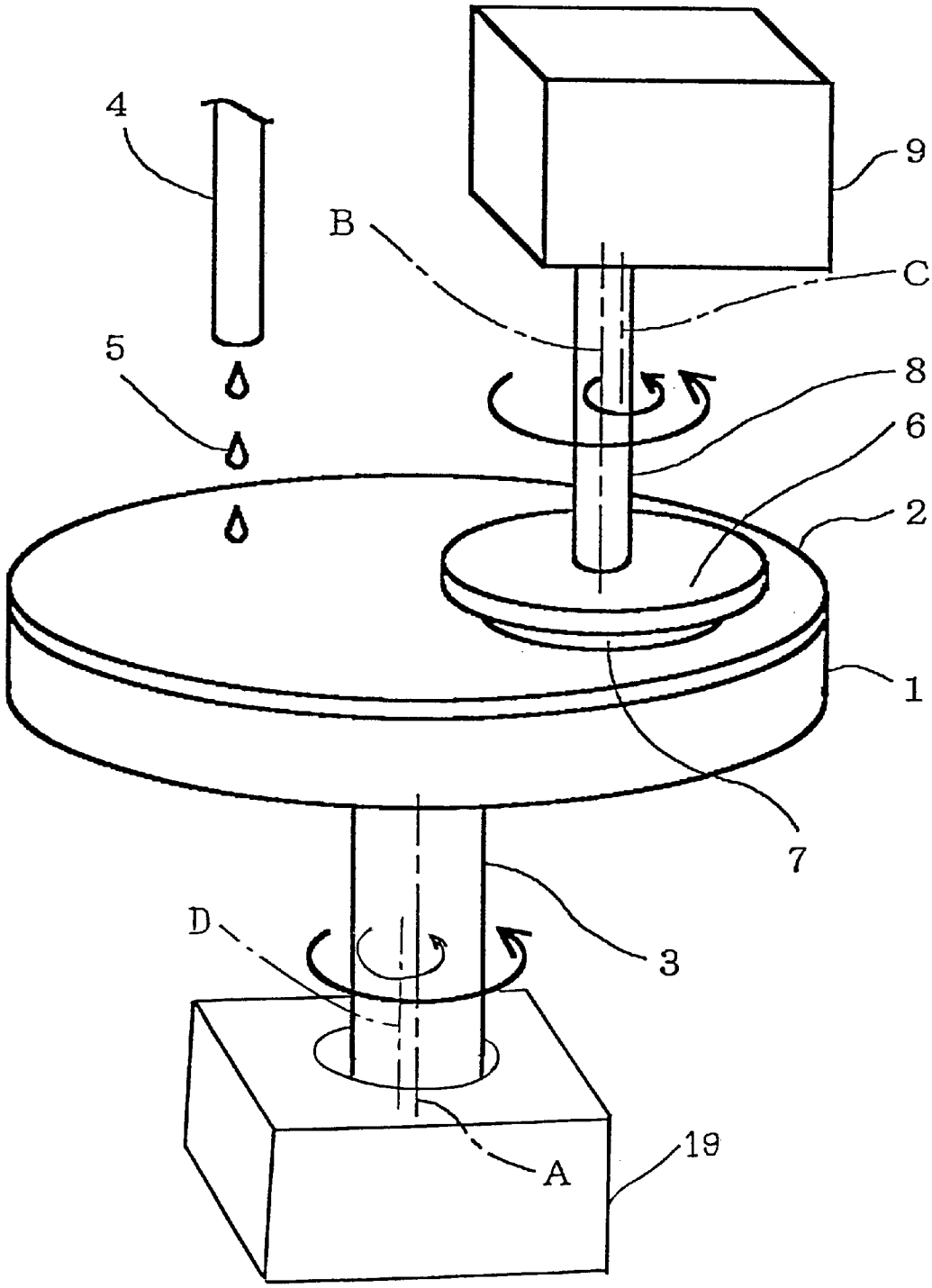
FIG. 5 is a perspective view representing a structure of a further modification of the polishing apparatus in accordance with one embodiment.
Figure 6A:
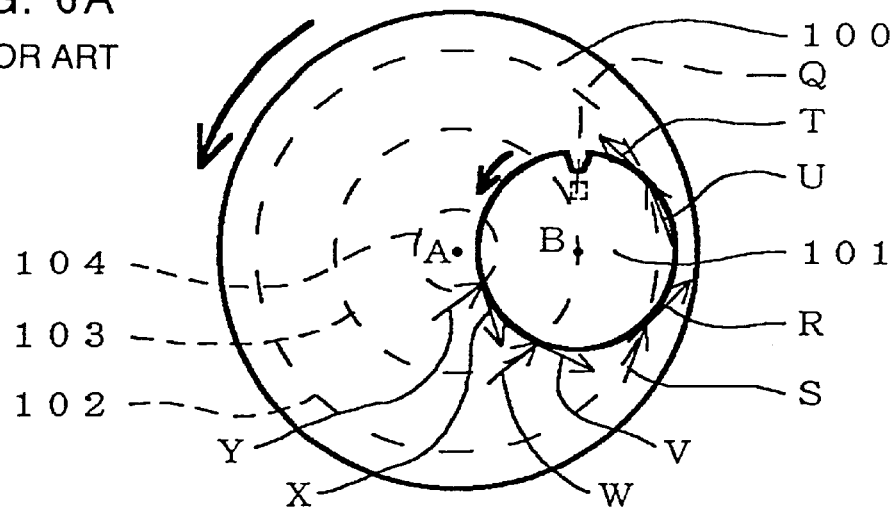
FIG. 6A PRIOR ART
FIGS. 6A, 6B and 6C are plan views representing positional relations between the polishing pad and the substrate when the substrate is polished by the conventional polishing apparatus and conventional polishing method, time sequentially for unit time period.
Figure 6B:
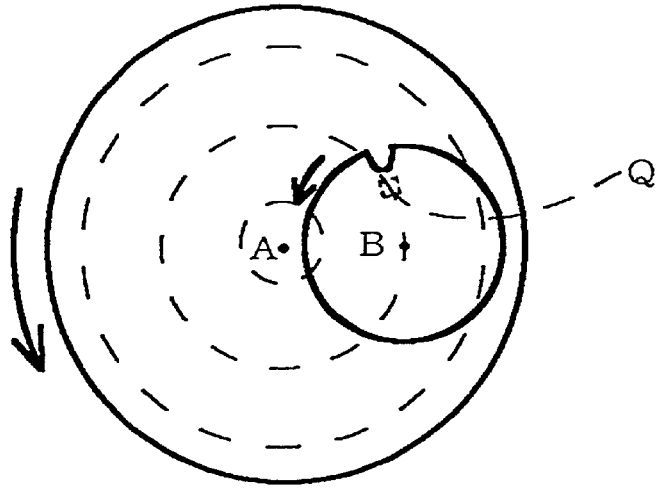
FIG. 6B PRIOR ART
Figure 6C:
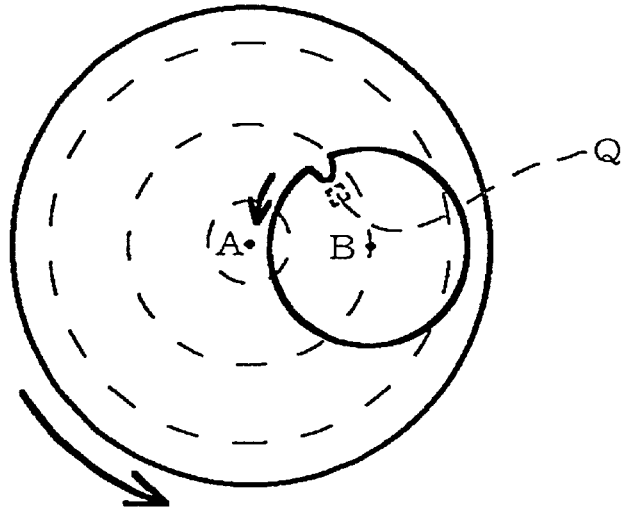
FIG. 6C PRIOR ART

In the foregoing, substrate axis B as an axis of the substrate rotating shaft 8 is rotated about the eccentric axis C. Alternatively, the surface plate axis A as an axis of surface plate rotating shaft 3 may be rotated about a prescribed eccentric axis D, as shown in FIG. 4. Further, both the substrate axis B and the surface plate axis A may be rotated about corresponding eccentric axes (C, D), as shown in FIG. 5. This arrangement can also attain the effect of increasing the polishing rate.

Further, the object of processing is not limited to a silicon substrate on which buried interconnections and interlayer insulating films are formed. For example, it may be an SOI (Silicon On Insulator) substrate, a compound semiconductor substrate, a glass substrate, a ceramic substrate or the like. Further, the present invention is also applicable to the substrate mentioned above before the buried interconnections or films such as the interlayer insulating films are formed. Though circular rotation has been described as the rotation about the eccentric axis, it is not limiting, and elliptical rotation may be utilized.

As described above, according to the polishing apparatus in accordance with the present embodiment, on the polishing pad, distance of movement of a small area of the substrate to be polished increases, and hence, the contact area between the small area and the polishing pad increases.

Further, the small area of the substrate to be polished is brought into contact with the polishing pad from various and many directions as compared with the conventional polishing. Accordingly, on the upper surface of the polishing pad, biased wear of abrasive grains can be prevented, and it becomes easier to remove clogging caused by fragments of abrasive grains dropped out from the upper surface of the polishing pad or fragments removed from the surface of the substrate to be polished.

Further, at least one of the polishing pad and the substrate to be polished revolves around an eccentric axis, at an angular velocity larger than that of rotation about the substrate axis. Therefore, slurry can be diffused uniformly with high efficiency between the polishing pad and the substrate to be polished.

From the foregoing, the present invention provides superior practical effects, whereby a polishing apparatus and a polishing method that can increase the polishing rate are provided.

Although the present invention has been described and illustrated in detail, it is clearly understood that the same is by way of illustration and example only and is not to be taken as a limitation of the spirit and scope of the present invention, which is defined by the appended claims.

What is claimed is:

1. A polishing apparatus in which a substrate to be polished rotated by a substrate rotating shaft is pressed against a polishing pad with a prescribed pressure while a slurry is supplied to an upper surface of said polishing pad rotated by a surface plate rotating shaft, so as to polish a surface of said substrate to be polished, comprising a rotating mechanism rotating at least one of a surface plate axis as a rotation central axis of said surface plate rotating shaft and a substrate axis as a rotation central axis of said substrate rotating shaft about at least one corresponding prescribed eccentric axis, wherein an angular velocity of rotation of said at least one of said surface plate axis and said substrate axis about said at least one eccentric axis is larger than an angular velocity of rotation of said substrate to be polished about said substrate axis.

2. The polishing apparatus according to claim 1, wherein said rotating mechanism rotates only said substrate axis of said substrate rotating shaft about a prescribed one said eccentric axis.

3. The polishing apparatus according to claim 1, wherein said rotating mechanism rotates only said surface plate axis of said surface plate rotating shaft about a prescribed one said eccentric axis.

4. A polishing method in which a slurry is supplied to an upper surface of a polishing pad rotated by a surface plate rotating shaft, a substrate to be polished is rotated by a substrate rotating shaft and said substrate to be polished is pressed against said polishing pad with a prescribed pressure so that a surface of said substrate to be polished is polished, comprising the step of rotating at least one of a surface plate axis as a rotation central axis of said surface plate rotating shaft and a substrate axis as a rotation central axis of said substrate rotating shaft about at least one corresponding prescribed eccentric axis, wherein at least one of said surface plate axis and said substrate axis is rotated about said at least one corresponding prescribed eccentric axis with an annular velocity larger than an angular velocity of rotation of said substrate to be polished about said substrate axis.

5. The polishing method according to claim 4, wherein only said substrate axis is rotated about a prescribed one said eccentric axis.

6. The polishing method according to claim 4, wherein only said surface plate axis is rotated about a prescribed one said eccentric axis.

* * * * *

UNITED STATES PATENT AND TRADEMARK OFFICE

CERTIFICATE OF CORRECTION

PATENT NO. : 6,712,674 B2
DATED : March 30, 2004
INVENTOR(S) : Matsuo et al.

It is certified that error appears in the above-identified patent and that said Letters Patent is hereby corrected as shown below:

Title page,
Item [*] Notice, delete the phrase "by 90 days" and insert -- by 18 days --

Signed and Sealed this

Nineteenth Day of April, 2005

JON W. DUDAS
*Director of the United States Patent and Trademark Office*